US008827726B2

(12) United States Patent
Chen

(10) Patent No.: US 8,827,726 B2
(45) Date of Patent: Sep. 9, 2014

(54) ELECTRIC CONNECTOR ASSEMBLY

(71) Applicant: Energy Full Electronics, Sindian (TW)

(72) Inventor: Chih-jung Chen, New Taipei (TW)

(73) Assignee: Energy Full Electronics, Sindian (TW)

( * ) Notice: Subject to any disclaimer, the term of this patent is extended or adjusted under 35 U.S.C. 154(b) by 76 days.

(21) Appl. No.: 13/759,427

(22) Filed: Feb. 5, 2013

(65) Prior Publication Data

US 2014/0170893 A1 Jun. 19, 2014

Related U.S. Application Data

(60) Provisional application No. 61/737,438, filed on Dec. 14, 2012.

(51) Int. Cl.
*H01R 24/00* (2011.01)

(52) U.S. Cl.
USPC ..... 439/144; 439/676

(58) Field of Classification Search
USPC ..... 439/676, 144, 79, 136, 142
See application file for complete search history.

(56) References Cited

U.S. PATENT DOCUMENTS

| | | | | | |
|---|---|---|---|---|---|
| 5,228,872 | A * | 7/1993 | Liu | 439/607.26 |
| 5,679,013 | A * | 10/1997 | Matsunaga et al. | 439/144 |
| 5,885,111 | A * | 3/1999 | Yu | 439/676 |
| 6,155,882 | A * | 12/2000 | Wu | 439/676 |
| 6,159,020 | A * | 12/2000 | Baker et al. | 439/49 |
| 6,319,070 | B1 * | 11/2001 | Tan | 439/680 |
| 6,869,297 | B2 * | 3/2005 | Caveney | 439/138 |
| 6,971,921 | B1 * | 12/2005 | Lai | 439/676 |
| 7,651,346 | B2 * | 1/2010 | Francis et al. | 439/136 |
| 2009/0017656 | A1 * | 1/2009 | Lee | 439/144 |
| 2009/0130913 | A1 * | 5/2009 | Yi et al. | 439/676 |
| 2009/0269988 | A1 * | 10/2009 | Zhuang | 439/676 |
| 2010/0273360 | A1 * | 10/2010 | Chen et al. | 439/676 |
| 2011/0136393 | A1 * | 6/2011 | Chang | 439/676 |

* cited by examiner

*Primary Examiner* — Gary Paumen
(74) *Attorney, Agent, or Firm* — Kirton McConkie; Evan R. Witt

(57) ABSTRACT

An electric connector assembly is disclosed. The electric connector assembly comprises a shell, a plurality of terminals, a spacer, a support plate, a housing, and a door. The spacer comprises a plurality of first openings. The support plate comprises a plurality of second openings. The spacer is positioned on the support plate. Each of the second openings is corresponding to one of the first openings. Each of the terminals is inserted in a corresponding first hole and a corresponding second hole. The shell is fixed to the support plate. The housing comprises two opposite sides. The shell is fixed to the housing. The door is locked to the sides. A sliding mechanism slides on the sides so that the door is closed or pulled out.

23 Claims, 10 Drawing Sheets

ELECTRIC CONNECTOR ASSEMBLY

CROSS-REFERENCE TO RELATED APPLICATIONS

This application claims the benefit of the filing date of U.S. provisional patent application Ser. No. 61/737,438, filed on Dec. 14, 2012, the disclosure of which is incorporated herein by reference.

BACKGROUND OF THE INVENTION

1. Field of the Invention

The present invention relates to an electric connector assembly, more particularly, to a thin electric connector assembly having a movable door.

2. Description of the Related Art

With the advent of the mobile era, all of the devices are thinner and thinner. The thinning is trendy, and the thinning of the mobile devices has become one of the most important subjects. There is no doubt that notebook computers, being one type of mobile device, are trended to be light, thin, small, and short. However, since the RJ45 plug, which is most extensively utilized as an I/O device for Internet connection, has a certain thickness. In an integrated design, the thickness of the RJ 45 connector must match the certain thickness. When considering the thicknesses of the upper rim and the lower rim, there is a limitation to the total thickness of products. Such a limitation therefore becomes a hindrance of the thinning of the mobile devices, such as an Ultrabook computer.

Therefore, it is very important to develop a new RJ45 connector to make full use of the space along the thickness direction in a notebook computer so the thinning becomes feasible.

SUMMARY OF THE INVENTION

The present invention provides an electric connector assembly having a movable door to allow the thinning of a notebook computer become feasible.

The present invention provides an electric connector assembly. The electric connector assembly comprises a shell, a plurality of terminals, a spacer, a support plate, a housing, and a door. The spacer comprises a plurality of first openings. The support plate comprises a plurality of second openings. The spacer is positioned on the support plate. Each of the second openings is corresponding to one of the first openings. Each of the terminals is inserted in a corresponding first hole and a corresponding second hole. The shell is fixed to the support plate. The housing comprises two opposite sides. The shell is fixed to the housing. The door is locked to the opposite sides. A sliding mechanism slides on the sides so that the door is closed or pulled out.

The present invention further provides an electric connector assembly. The electric connector assembly comprises a shell, a plurality of terminals, a spacer, a support plate, a housing, a door, and a sliding mechanism. The spacer comprises a plurality of first openings. The support plate comprises a plurality of second openings. The spacer is positioned on the support plate. Each of the second openings is corresponding to one of the first openings. Each of the terminals is inserted in a corresponding first hole and a corresponding second hole. The shell is fixed to the support plate. The housing comprises two opposite sides. The shell is fixed to the housing. The sliding mechanism comprises two guide slots and two slide members. Each of the guide slots is disposed in one of the sides. Each of the slide members is locked in one of the guide slots. The door is locked to the sides with the slide members. Each of the slide members slides along the corresponding guide slot so that the door is closed or pulled out.

In contrast to the prior art, the present invention electric connector assembly has an embedded and movable door. When the door is opened, the RJ 45 plug is allowed to be plugged in. When there is no necessity to utilize Internet, the door can be pulled back. Hence, the space along the thickness direction and originally used for accommodating the door can be utilized when the RJ 45 plug is plugged in. At the same time, when the door is closed it functions like the lower rim. As a result, not only is the space along the thickness direction of the notebook computer fully utilized, but also the thinning of the notebook computer becomes feasible. Furthermore, the door can be pulled out, pulled down, and pulled back manually with simple operations. In addition, when the notebook computer is equipped with the present invention electric connector assembly, the whole structure is pleasing to the eye and the structural integrity is retained.

The invention is illustrated in detail in consideration of the following detailed description of preferred embodiment of the disclosure in connection with the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

The accompanying drawings and embodiments are included to provide a detailed description of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Figure 1:
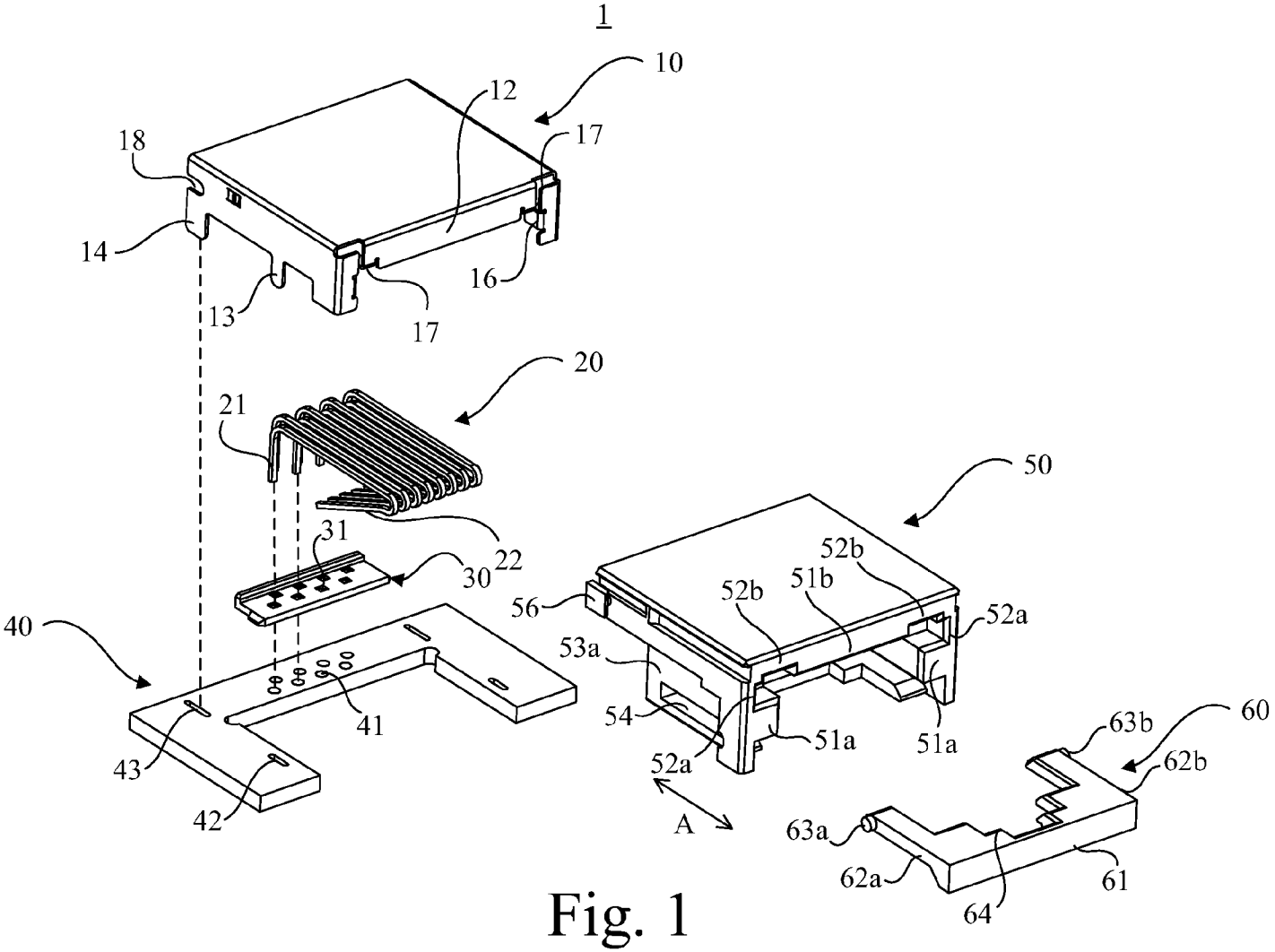
FIG. 1 is an exploded perspective view of a preferred embodiment of the present invention.
Figure 2:
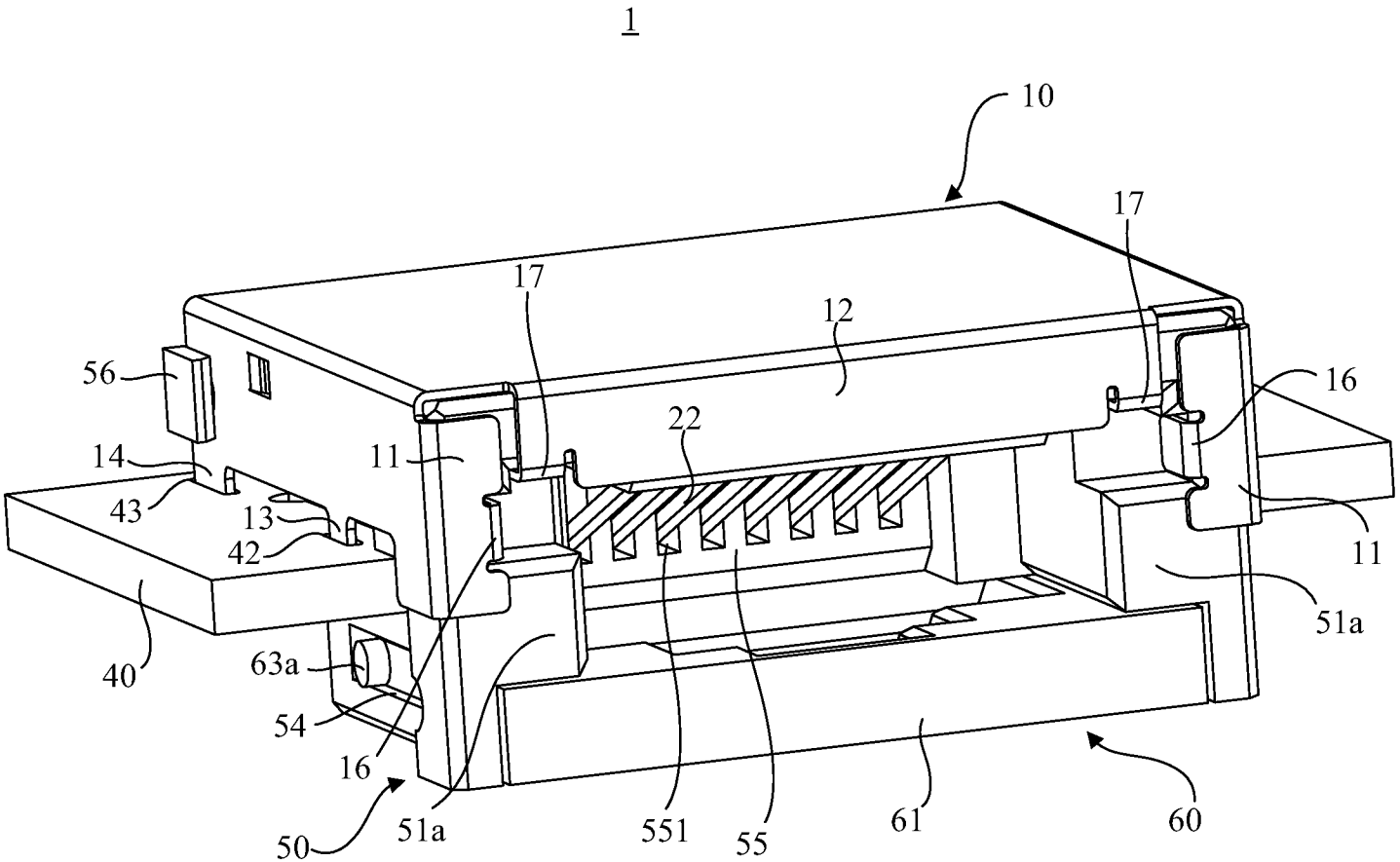
FIG. 2 is a perspective view of the preferred embodiment of the present invention.

Please refer to FIG. 1 and FIG. 2. According to a preferred embodiment of the present invention, a present invention electric connector assembly 1 comprises a shell 10, a plurality of terminals 20, a spacer 30, a support plate 40, a housing 50, and a door 60. The shell 10, usually made of metal, is used for providing a shield and protection for the housing 50. The shell 10 comprises at least one first extension sheet 11, at least one second extension sheet 12, at least one first alignment pin 13, at least one second alignment pin 14, and at least one locking member 15. The first extension sheet 11 comprises a first bending portion 16, and the second extension sheet 12 comprises at least one second bending portion 17 (as shown in FIG. 2). The locking member 15, based on the practical situation, may have different designs. In FIG. 1, a recess is taken as an example. The terminal 20 comprises a contact portion 21 and a reverse hook portion 22. Each of the contact portions 21 of the plurality of terminals 20 is straightly inserted in one of a plurality of openings 31 of the spacer 30.

The support plate 40 comprises a plurality of openings 41, at least one first fixing hole 42, and at least one second fixing hole 43. The spacer 30 is positioned on the support plate 40 so that one of the openings 41 is corresponding to one of the openings 31 of the spacer 30. The first fixing hole 42 and the second fixing hole 43 are respectively corresponding to the first alignment pin 13 and the second alignment pin 14. When each of the contact portions 21 of the plurality of terminals 20 is straightly inserted in one of the plurality of openings 31 of the spacer 30, it is also straightly inserted in one of the openings 41 of the support plate 40.

The housing 50 is used for supporting the plurality of terminals 20 which are contact elements and isolating. The housing 50 is usually made of resin. The housing 50 comprises at least one first raised portion 51*a* and a first recess portion 52*a* over the first raised portion 51*a*. The housing 50 further comprises at least one second raised portion 51*b* and a second recess portion 52*b* on at least one side of the second raised portion 5 lb. At the same time, there is a guide slot 54 disposed in each of two sides 53*a*, 53*b* of the housing 50. The door 60 comprises a front side 61 and two sides 62*a*, 62*b* corresponding to the two sides 53*a*, 53*b* of the housing 50. A slide member 63*a* and a slide member 63*b* are disposed on the side 62*a* and the side 62*b* respectively. When the slide members 63*a*, 63*b* are respectively locked in the guide slots 54 in the two sides 53*a*, 53*b* of the housing 50, they are allowed to move back and forth along directions indicated by a double-headed arrow A shown in FIG. 1. The door 60 is thus opened or closed. The door 60 comprises a supporting portion 64. The supporting portion 64 is used for supporting an elastic locking member (not shown in the figures) of the RJ 45 plug (not shown in the figures) when the RJ 45 plug is plugged into the electric connector assembly 1 to improve the stability of the plug-in.

After the contact portion 21 of each of the terminals 20 is straightly inserted in one of the openings 31 of the spacer 30 and one of the openings 41 of the support plate 40, all of the terminals 20, the spacer 30, and the support plate 40 form an integrated structure. The integrated structure can be inserted into a slot structure 55 of the housing 50 conveniently and speedily. The slot structure 55 comprises eight slots 551 (as shown in FIG. 2). Each of the eight slots 551 accommodates one terminal 20. Not only is the alignment convenient, but also the possibility of the short-circuiting between each of the terminals 20 is reduced. Of course, when designing the openings 31 of the spacer 30, the openings 41 of the support plate 40, and the slot structure 55 of the housing 50, their positions (for example: an interval between the neighboring openings 31, an interval between the neighboring openings 41, an interval between the neighboring slots 551, and relative positions of all openings 31, all openings 41, and all slots 551) and their sizes (for example: diameters of the opening 31 and the opening 41, a width of the slot 551) must be considered properly so that the above-mentioned beneficial effects can be achieved. After being inserted, the reverse hook portion 22 of each of the terminals 20 extends from one of the slots 551.

After that, please refer to FIG. 1 and FIG. 2, the shell 10 is fixed to the housing 50 and the support plate 40. The first alignment pin 13 of the shell 10 is inserted into the first fixing hole 42 of the support plate 40, and the second alignment pin 14 is inserted into the second fixing hole 43. Furthermore, the first bending portion 16 of the first extension sheet 11 of the shell 10 presses against the first recess portion 52*a* over the first raised portion 51*a* of the housing 50, and the second bending portion 17 of the second extension sheet 12 presses against the second recess portion 52*b* on the side of the second raised portion 51*b*. The locking member 15 of the shell 10 is locked by a snap 56 disposed on the housing 50. Therefore, any relative movement between the shell 10, the housing 50, and the above-mentioned integrated structure formed by all of the terminals 20, the spacer 30, and the support plate 40 is prevented.

Figure 3:
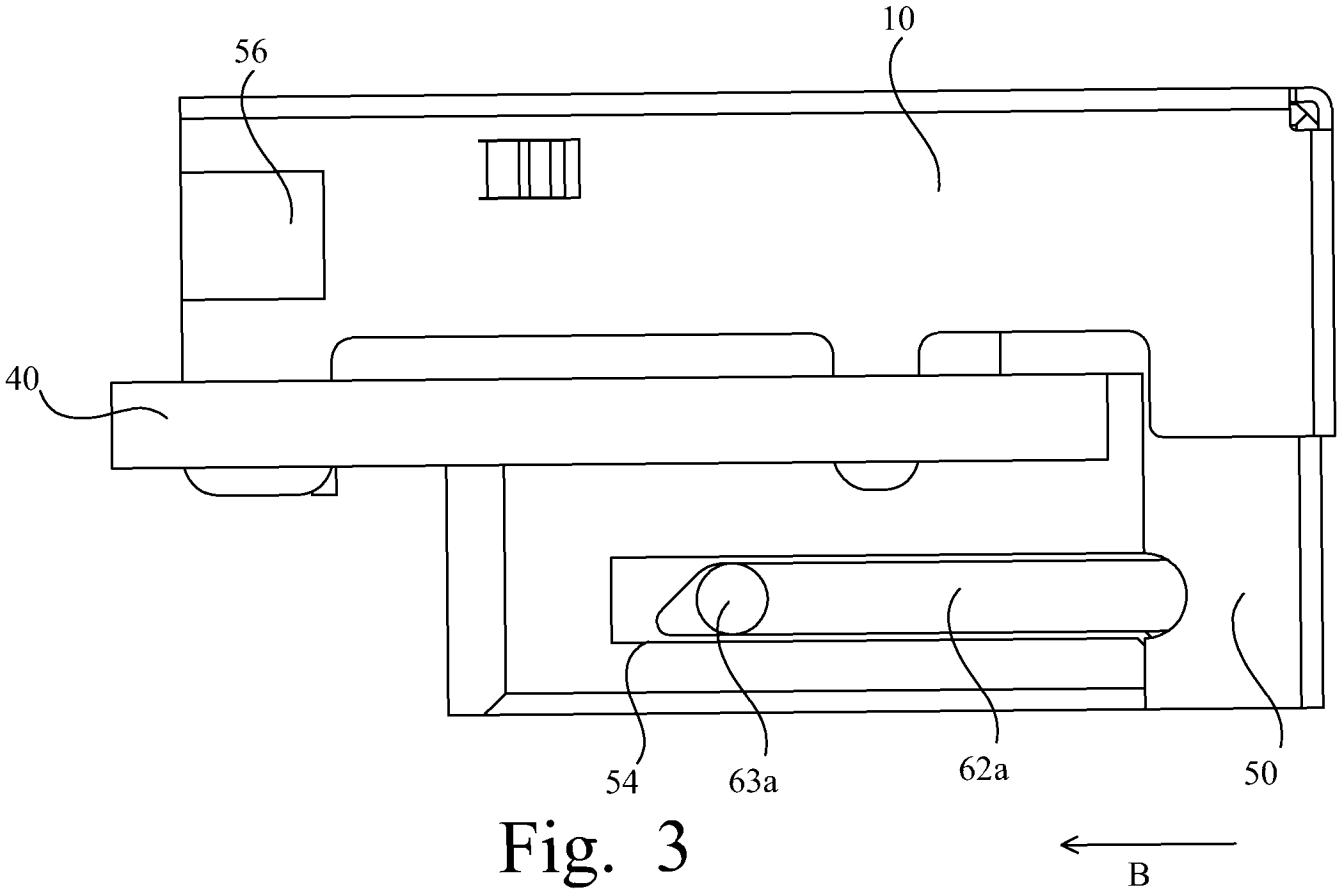
FIG. 3 is a schematic diagram showing a close operation of the door according to the preferred embodiment of the present invention.
Figure 4:
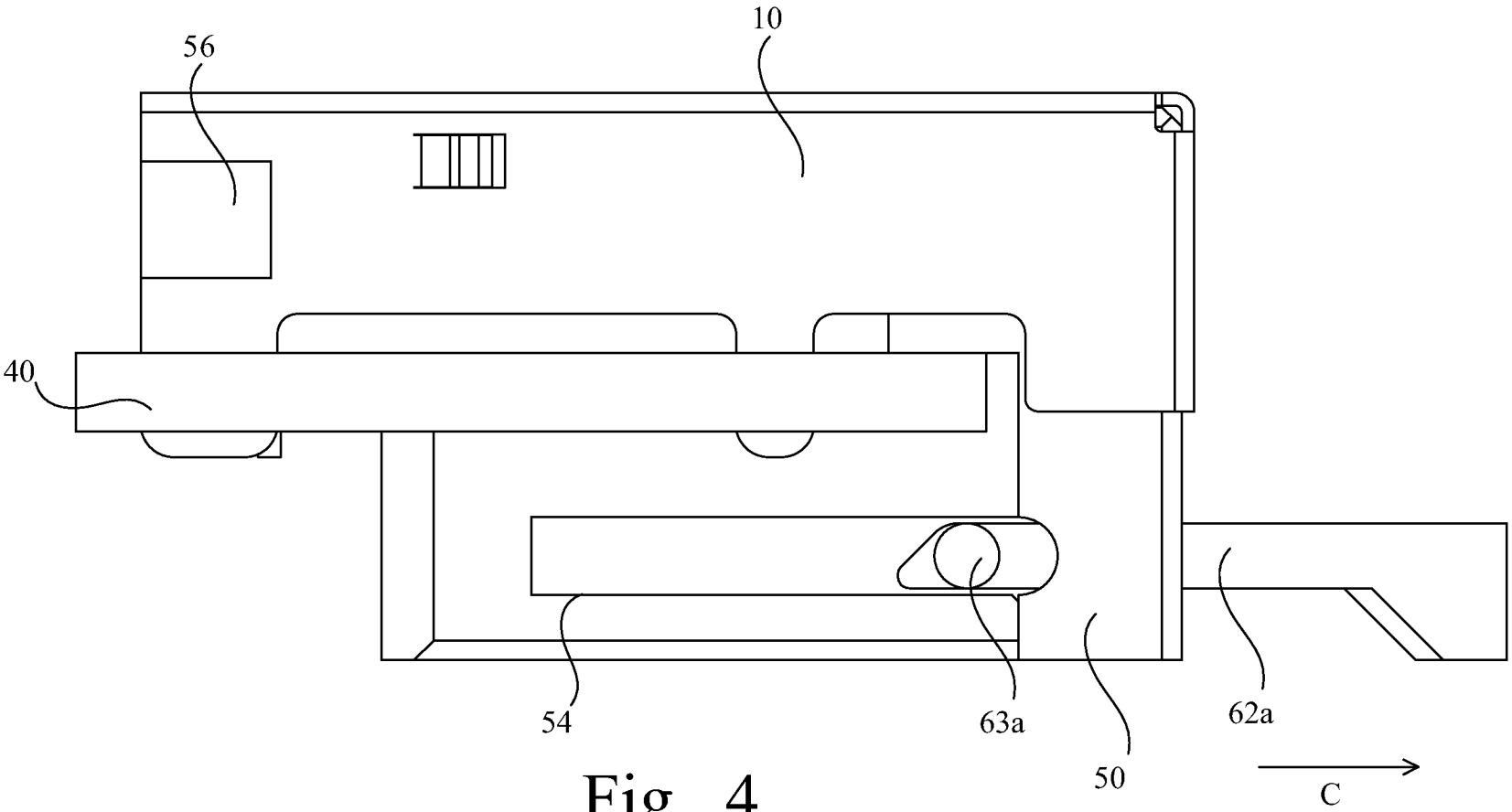
FIG. 4 is a schematic diagram showing a pull-out operation of the door according to the preferred embodiment of the present invention.
Figure 5:
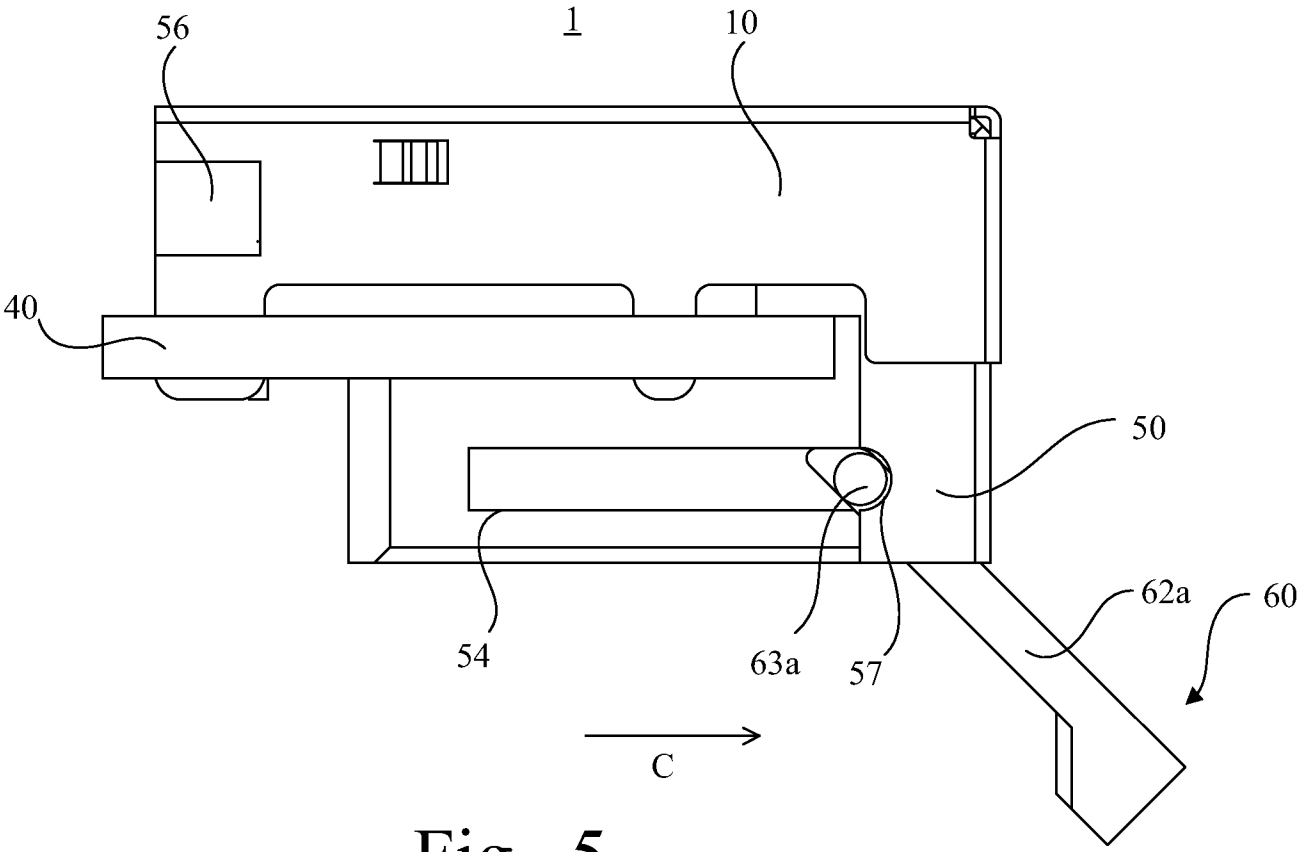
FIG. 5 is schematic diagram showing a pull-down operation of the door according to the preferred embodiment of the present invention.
Figure 6:
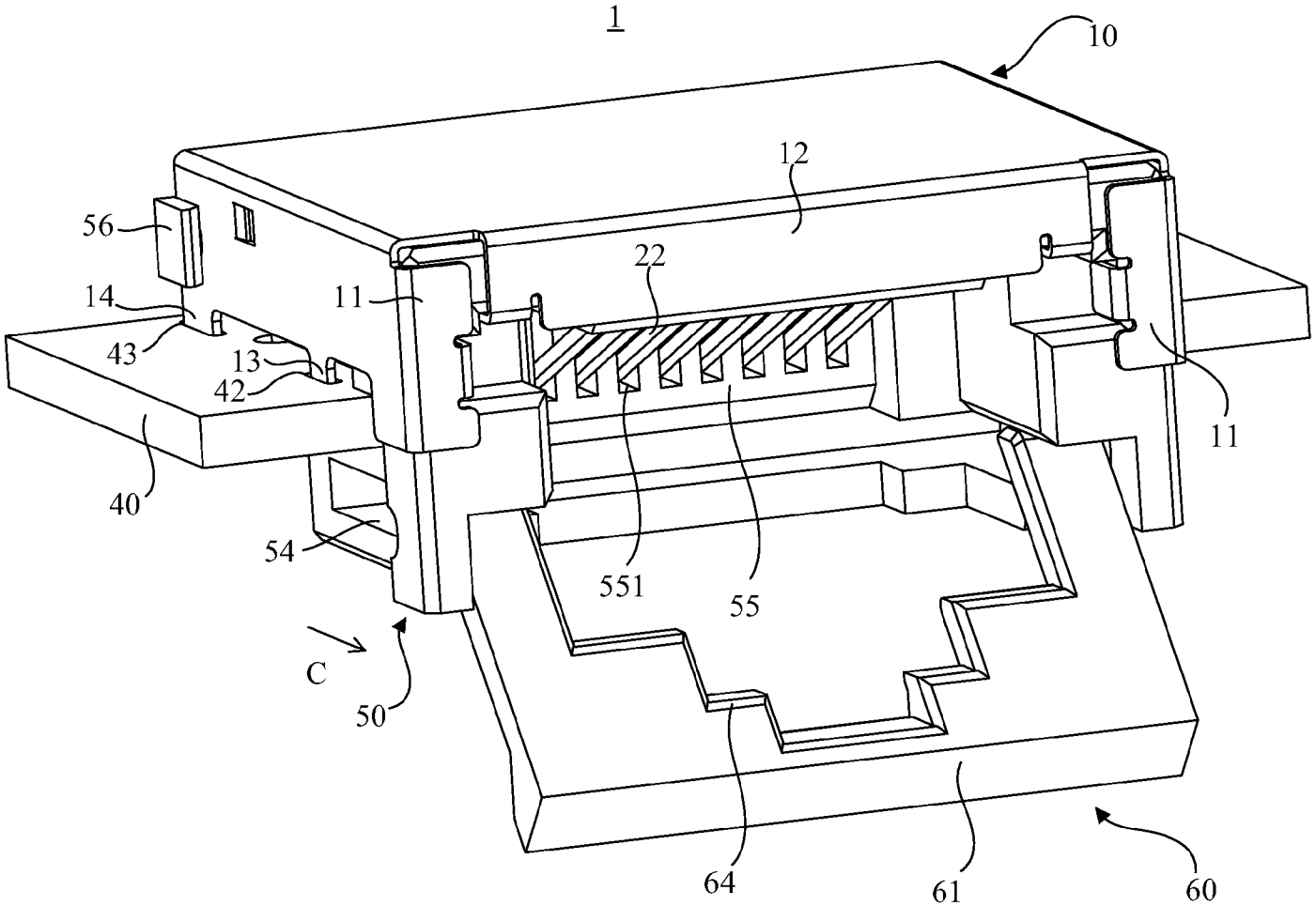
FIG. 6 is a perspective view of the door in a pull-down state according to the preferred embodiment of the present invention.

As mentioned previously, when the slide members 63*a*, 63*b* on the sides 62*a*, 62*b* of the door 60 are respectively locked in the guide slots 54 in the two sides 53*a*, 53*b* of the housing 50, the door 60 is allowed to move along the directions indicated by the double-headed arrow A shown in FIG. 1. Please refer to FIG. 3, when the slide member 63*a* on the side 62*a* of the door 60 moves to a particular point in the guide slot 54 along a direction indicated by an arrow B, the door 60 will not protrude from the housing 50 (please also refer to FIG. 2). The door 60 is thus in a closed state, and RJ 45 plug (not shown in the figure) is not allowed to be plugged into the electric connector assembly 1. Please refer to FIG. 4, when the slide member 63*a* on the side 62*a* of the door 60 moves to another point in the guide slot 54 along a direction indicated by an arrow C, the door 60 will protrude from the housing 50 and is in a pull-out state. Please refer to FIG. 5 and FIG. 6, when the slide member 63*a* on the side 62*a* of the door 60 moves to a front edge 57 of the guide slot 54 along the direction indicated by the arrow C, the slide member 63*a* is allowed to rotate an angle along the front edge 57 because a shape of the front edge 57 matches a shape of the slide member 63*a*. For example, in the figures the semi-circular front edge 57 cooperates with the cylindrical slide member 63*a* (please also refer to FIG. 1). The opened door 60 is thus pulled down. As a result, the door 60 is in a pull-down state to allow the RJ 45 plug (not shown in the figures) to be plugged into the electric connector assembly 1.

Figure 7:
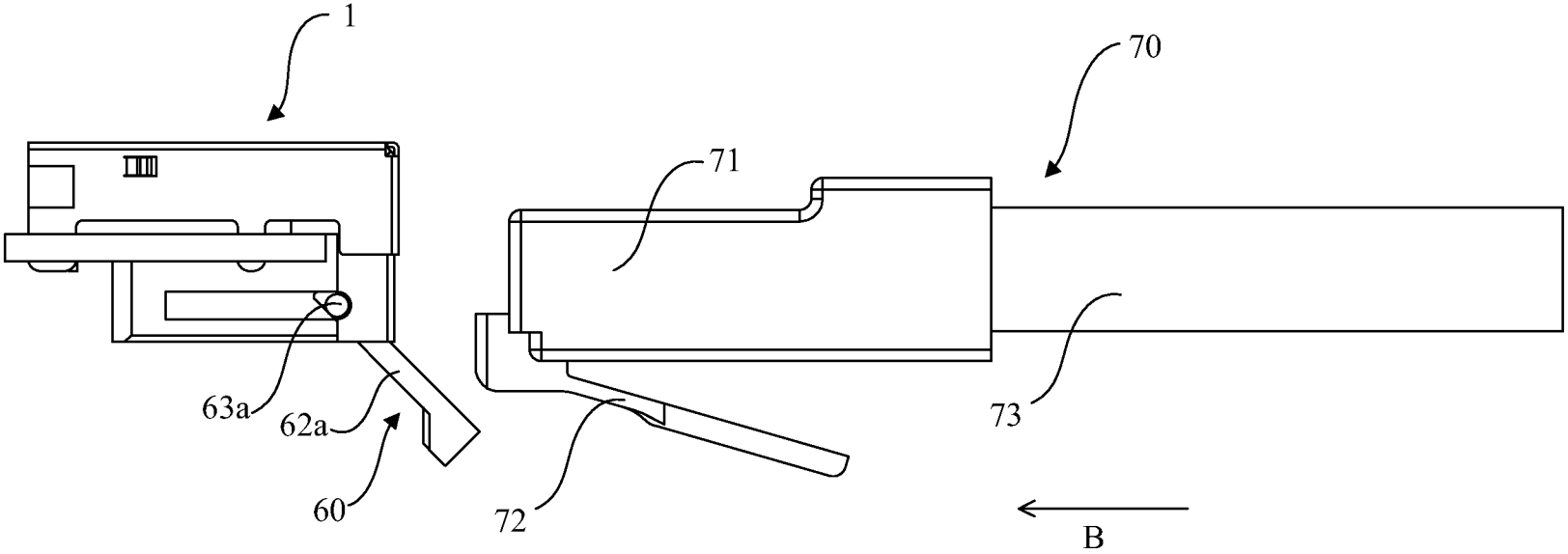
FIG. 7 is a schematic diagram showing a plug-in operation of a RJ45 plug according to the preferred embodiment of the present invention (1).
Figure 8:
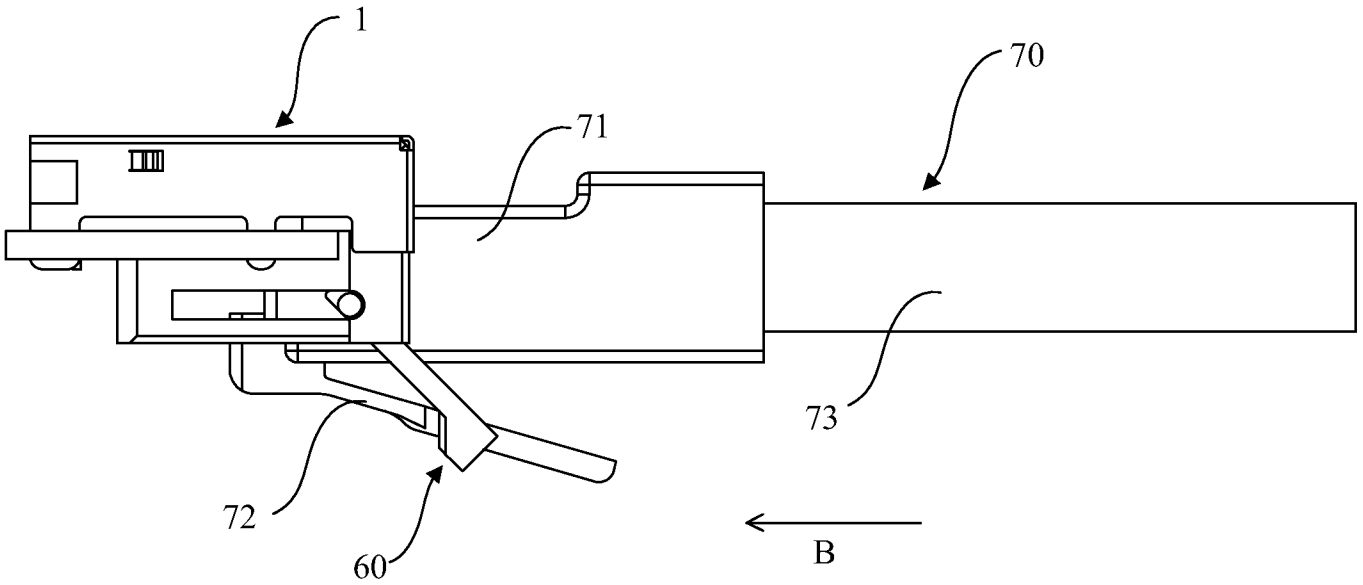
FIG. 8 is a schematic diagram showing the plug-in operation of the RJ45 plug according to the preferred embodiment of the present invention (2).

Please refer to FIG. 7 and FIG. 8, when the door 60 is in the pull-down state, a RJ 45 plug 70 is plugged into the electric connector assembly 1 along the direction indicated by the arrow B. The RJ 45 plug 70 comprises a plug 71, an elastic locking member 72, and an Internet cable 73. When terminals (not shown in the figures) in the plug 71 contact the reverse hook portions 22 of the terminals 20 extending from the slots 551 of the electric connector assembly 1 (please also refer to FIG. 2), an electric connection occurs so a user can start utilizing Internet. Moreover, since there is a supporting portion 64 in the door 60 (please also refer to FIG. 1 and FIG. 6), the supporting portion 64 is able to properly support the elastic locking member 72 of the RJ 45 plug 70 when the RJ 45 plug 70 is plugged into the electric connector assembly 1. Hence, the RJ 45 plug 70 will not shake to avoid the problem of poor contact. The supporting portion 64, depending on the practical situation, may have different designs. In the figures, only one type of supporting portion is illustrated. Of course, a plug-in depth of the RJ 45 plug 70 in the electric connector assembly 1, a shape of the elastic locking member 72, and a size of the elastic locking member 72 need to be considered when designing.

Figure 9:
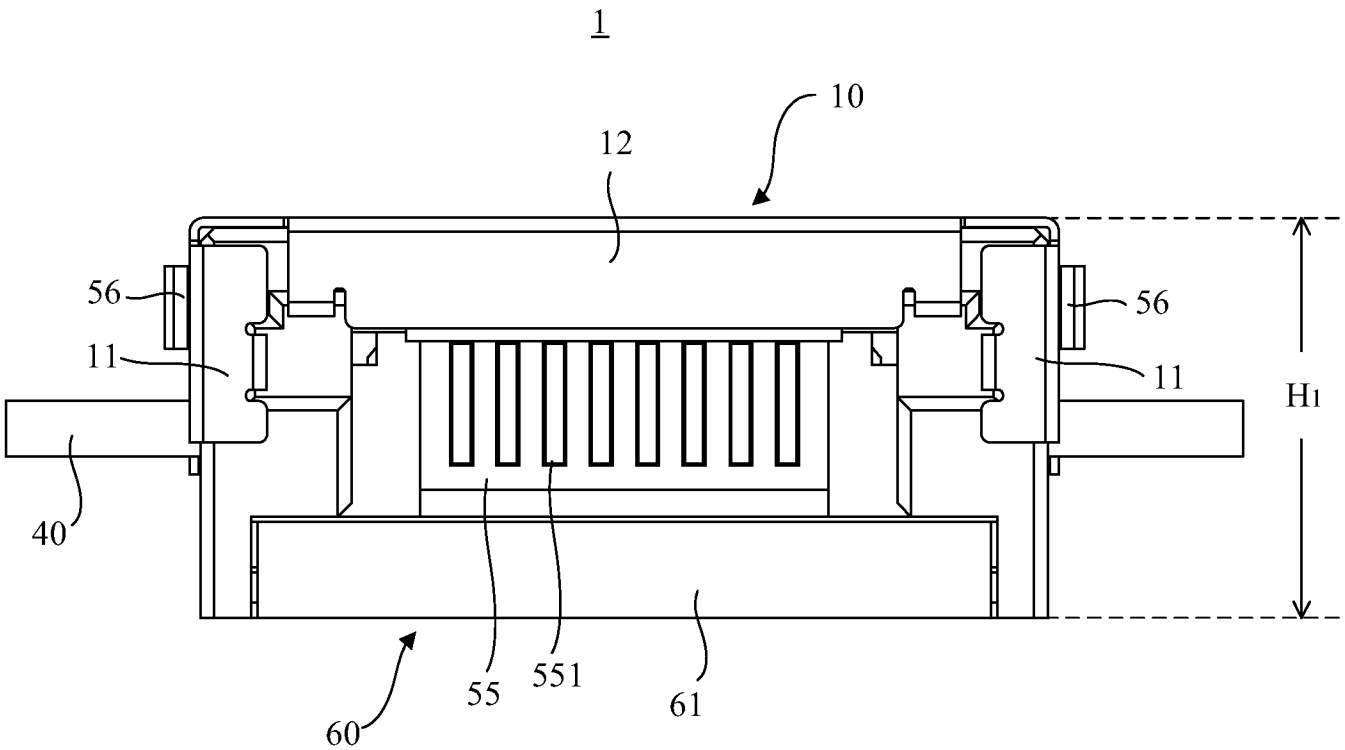
FIG. 9 is a schematic diagram showing a thickness of the electric connector assembly when the door is in the closed state according to the preferred embodiment of the present invention.
Figure 10:
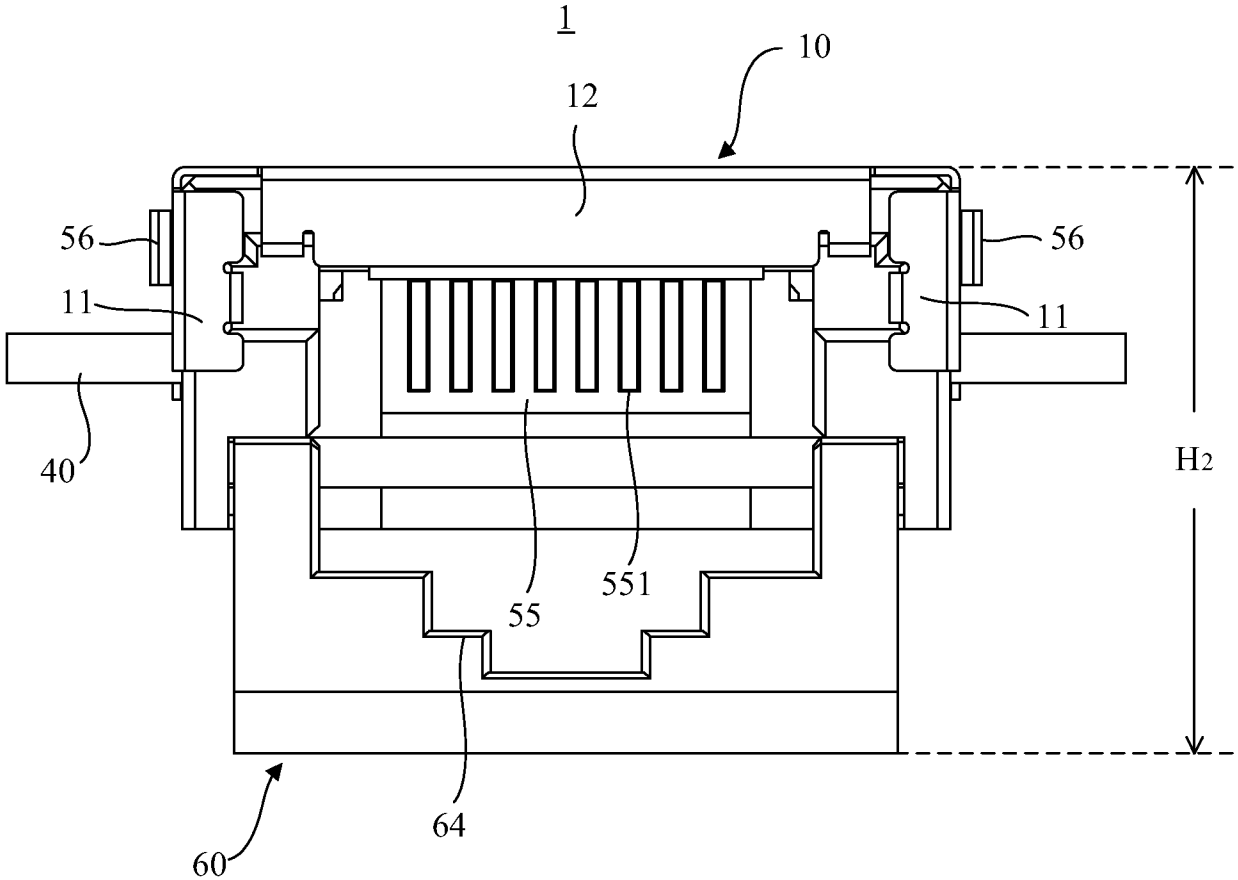
FIG. 10 is a schematic diagram showing a thickness of the electric connector assembly when the door is in the pull-down state according to the preferred embodiment of the present invention.

In any case, the space originally used for accommodating the door 60 is used for accommodating the RJ 45 plug 70 after the RJ 45 plug 70 is plugged in. Moreover, when the door 60 is closed it functions like the lower rim. Therefore, the dimension along the thickness direction of a notebook computer is decreased. Please refer to FIG. 9 and FIG. 10. As shown in FIG. 9, a thickness $H_1$ of the present invention electric connector assembly 1 when the door 60 is in the closed state is less than 9 mm, for example: 8.7 mm. As shown in FIG. 10, a thickness $H_2$ of the present invention electric connector assembly 1 when the door 60 is in_the pull-down state is approximately 14.0 mm.

In summary, the present invention electric connector assembly has an embedded and movable door. When the door is opened, the RJ 45 plug is allowed to be plugged in. When there is no necessity to utilize Internet, the door can be pulled back. Hence, the space along the thickness direction and originally used for accommodating the door can be utilized when the RJ 45 plug is plugged in. At the same time, when the door is closed it functions like the lower rim. As a result, not only is the space along the thickness direction of the notebook computer fully utilized, but also the thinning of the notebook computer becomes feasible. Furthermore, the door can be pulled out, pulled down, and pulled back manually with simple operations. In addition, when the notebook computer is equipped with the present invention electric connector assembly, the whole structure is pleasing to the eye and the structural integrity is retained.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electric connector assembly, comprising:

a shell;

a plurality of terminals;

a spacer comprising a plurality of first openings;

a support plate comprising a plurality of second openings, the spacer being positioned on the support plate, each of the second openings being corresponding to one of the first openings, each of the terminals being inserted in a corresponding first opening and a corresponding second opening, and the shell being fixed to the support plate;

a housing comprising two opposite sides, and the shell being fixed to the housing; and a door being locked to the opposite sides;

wherein a sliding mechanism slides on the sides so that the door is closed or pulled out.

2. The electric connector assembly as claimed in claim 1, wherein each of the terminals is inserted in the corresponding first opening and the corresponding second opening to form an integrated structure constituted by the terminals, the spacer, and the support plate.

3. The electric connector assembly as claimed in claim 2, wherein the integrated structure is inserted into a slot structure of the housing so that a reverse hook portion of each of the terminals extends from a slot of the slot structure.

4. The electric connector assembly as claimed in claim 1, wherein at least one alignment pin of the shell is inserted into a corresponding fixing hole of the support plate so that the shell is fixed to the support plate.

5. The electric connector assembly as claimed in claim 1, wherein at least one bending portion of the shell presses against a corresponding recess portion of the housing so that the shell is fixed to the housing.

6. The electric connector assembly as claimed in claim 1, wherein a locking member of the shell is locked by a corresponding snap disposed on the housing so that the shell is fixed to the housing.

7. The electric connector assembly as claimed in claim 1, wherein the sliding mechanism comprises two guide slots and two slide members, each of the guide slots is disposed in one of the two sides, and each of the slide members is locked in one of the guide slots.

8. The electric connector assembly as claimed in claim 7, wherein the door is locked to the sides with the slide members.

9. The electric connector assembly as claimed in claim 7, wherein each of the slide members slides along the corresponding guide slot to pull out the door.

10. The electric connector assembly as claimed in claim 9, wherein each of the slide members rotates along a from edge of the corresponding guide slot to pull down the door after the door is pulled out.

11. The electric connector assembly as claimed in claim 10, wherein the electric connector assembly is adapted to be plugged by a plug when the door is pulled down.

12. The electric connector assembly as claimed in claim 11, wherein the plug is a RJ 45 plug.

13. The electric connector assembly as claimed in claim 12, wherein the door comprises a supporting portion used for supporting an elastic locking member of the RJ 45 plug.

14. An electric connector assembly, comprising:

a shell;

a plurality of terminals;

a spacer comprising a plurality of first openings;

a support plate comprising a plurality of second openings, the spacer being positioned on the support plate, each of the second openings being corresponding to one of the first openings, each of the terminals being inserted in a corresponding first opening and a corresponding second opening, and the shell being fixed to the support plate;

a housing comprising two opposite sides, and the shell being fixed to the housing;

a door; and a sliding mechanism comprising two guide slots and two slide members, each of the guide slots being disposed in one of the sides, each of the slide members being locked in one of the guide slots, and the door being locked to the sides with the slide members;

wherein each of the slide members slides along the corresponding guide slot so that the door is closed or pulled out.

15. The electric connector assembly as claimed in claim 14, wherein each of the terminals is inserted in the corresponding first opening and the corresponding second opening to form an integrated structure constituted by the terminals, the spacer, and the support plate.

16. The electric connector assembly as claimed in claim 15, wherein the integrated structure is inserted into a slot structure of the housing so that a reverse hook portion of each of the terminals extends from a slot of the slot structure.

17. The electric connector assembly as claimed in claim 14, wherein at least one alignment pin of the shell is inserted into a corresponding fixing hole of the support plate so that the shell is fixed to the support plate.

18. The electric connector assembly as claimed in claim 14, wherein at least one bending portion of the shell presses against a corresponding recess portion of the housing so that the shell is fixed to the housing.

19. The electric connector assembly as claimed in claim 14, wherein a locking member of the shell is locked by a corresponding snap disposed on the housing so that the shell is fixed to the housing.

20. The electric connector assembly as claimed in claim 14, wherein each of the slide members rotates along a front edge of the corresponding guide slot to pull down the door after the door is pulled out.

21. The electric connector assembly as claimed in claim 20, wherein the electric connector assembly is adapted to be plugged by a plug when the door is pulled down.

22. The electric connector assembly as claimed in claim 21, wherein the plug is a RJ 45 plug.

23. The electric connector assembly as claimed in claim 22, wherein the door comprises a supporting portion used for supporting an elastic locking member of the RJ 45 plug.

* * * * *